US009420364B2

(12) United States Patent
Chang

(10) Patent No.: US 9,420,364 B2
(45) Date of Patent: Aug. 16, 2016

(54) DISPLAY DEVICE WITH SOUND GENERATION REGIONS HAVING DIFFERENT AREAS

(71) Applicant: HON HAI PRECISION INDUSTRY CO., LTD., New Taipei (TW)

(72) Inventor: Jen-Tsorng Chang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/551,912

(22) Filed: Nov. 24, 2014

(65) Prior Publication Data

US 2016/0094902 A1 Mar. 31, 2016

(30) Foreign Application Priority Data

Sep. 30, 2014 (TW) ..... 103133852 A

(51) Int. Cl.
*H04R 1/02* (2006.01)

(52) U.S. Cl.
CPC ..... *H04R 1/028* (2013.01); *H04R 2499/15* (2013.01)

(58) Field of Classification Search
None
See application file for complete search history.

(56) References Cited

U.S. PATENT DOCUMENTS

| | | | | |
|---|---|---|---|---|
| 7,174,025 | B2 * | 2/2007 | Azima | H04R 7/045 381/152 |
| 7,764,803 | B2 * | 7/2010 | Kang | H04R 7/04 381/152 |
| 2012/0243719 | A1 * | 9/2012 | Franklin | G06F 1/1652 381/333 |
| 2015/0086048 | A1 * | 3/2015 | Brown | H04R 1/02 381/152 |
| 2015/0086063 | A1 * | 3/2015 | Louh | H04R 1/028 381/388 |

* cited by examiner

*Primary Examiner* — Brenda Bernardi
(74) *Attorney, Agent, or Firm* — ScienBiziP, P.C.

(57) ABSTRACT

A display device includes a housing, a protective glass, a display panel, a vibration glass layer, and a fastening frame. The display panel is positioned on the housing. The vibration glass layer includes a transparent portion on the display panel and a sound generation portion extending from sides of the transparent portion to the housing. The fastening frame is positioned on the vibration glass layer between the vibration glass layer and the protective glass. The fastening frame includes a base portion and rib portions. The base portion surrounds the transparent portion. The rib portions extend from the base portion to the housing. The rib portions divide the sound generation portion into sound generation regions. The sound generation regions have different areas.

20 Claims, 3 Drawing Sheets

DISPLAY DEVICE WITH SOUND GENERATION REGIONS HAVING DIFFERENT AREAS

FIELD

The subject matter herein generally relates to display devices, and particularly to a display device having a sound generation structure.

BACKGROUND

Nowadays, most electrical devices, for example cell phones, tablet computers, and MP3 players, include internal speakers. The speakers generally apply vibration diaphragms to vibrate, so as to generate sound waves. However, the electrical devices have variable internal structures, and the speakers with the vibration diaphragms can be bulky. As such, the speakers with the vibration diaphragms may not be easily received in the variable internal structures.

BRIEF DESCRIPTION OF THE DRAWINGS

Implementations of the present technology will now be described, by way of example only, with reference to the attached figures, wherein.

DETAILED DESCRIPTION

Figure 1:
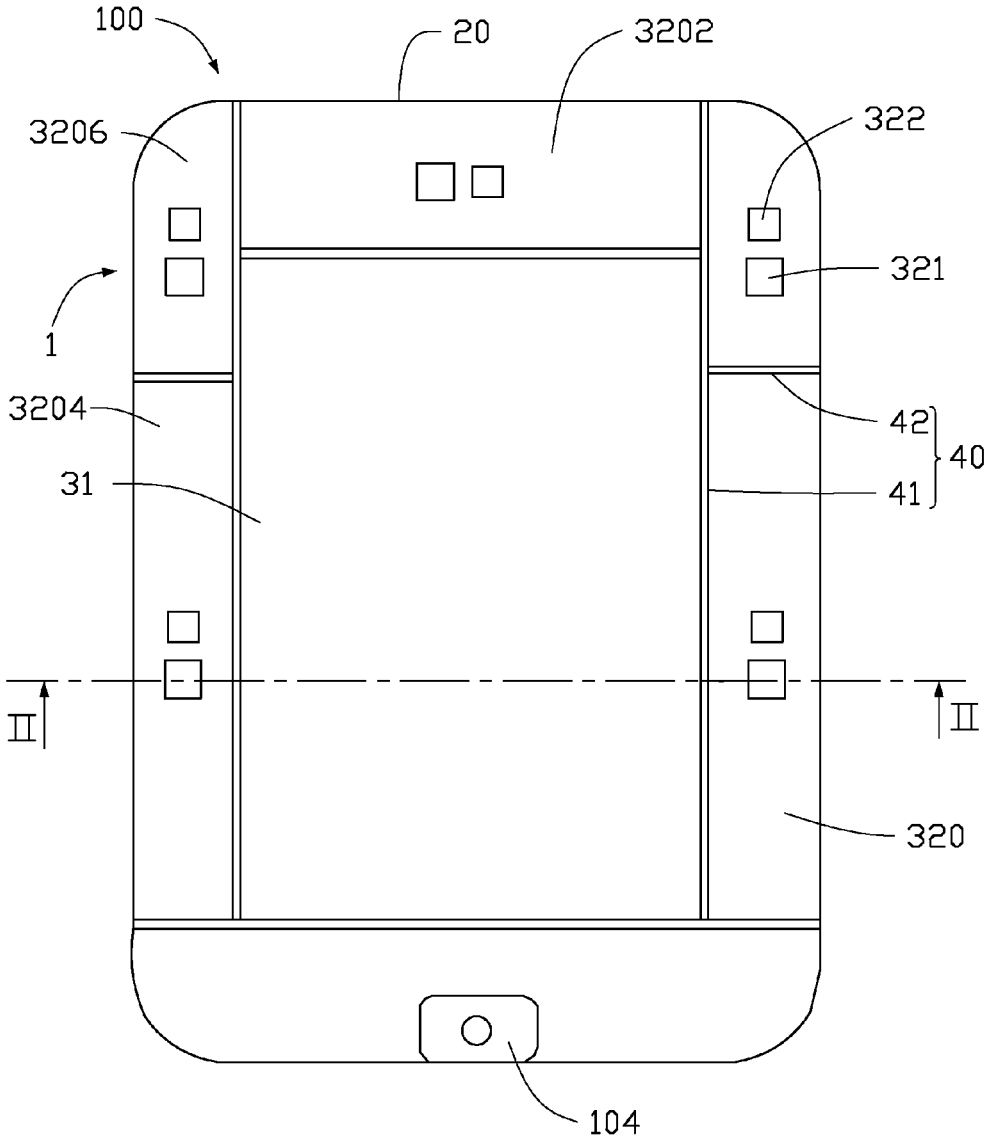
FIG. 1 is an isometric view illustrating an embodiment of an electrical device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like.

Figure 2:
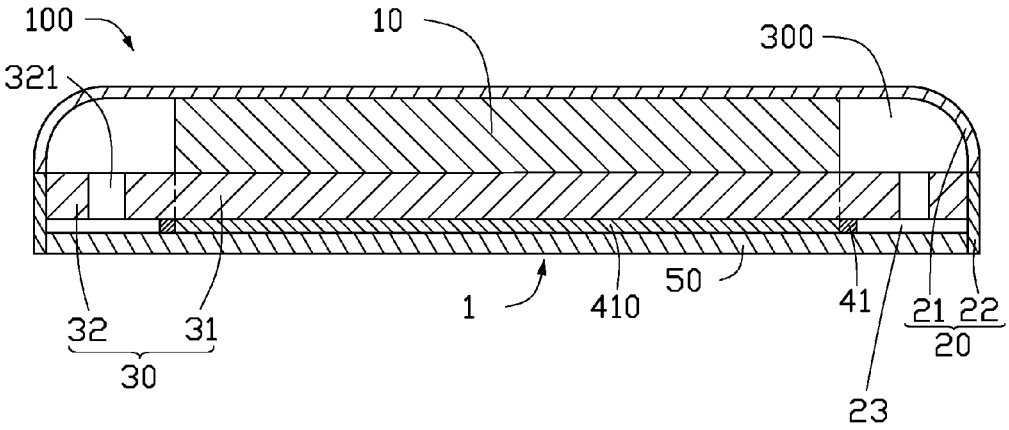
FIG. 2 is a cross-sectional view illustrating the electrical device, taken along line II-II of FIG. 1.

Referring to FIGS. 1-2, an embodiment of a display device 1 is shown. The display device 1 can be used in an electrical device 100. The electrical device 100 can be a mobile phone, a tablet computer, or music player. The display device 1 includes a display panel 10, a housing 20, a vibration glass layer 30, a fastening frame 40, and a protective glass 50. The protective glass 50 is fixed to the housing 20. The protective glass 50 and the housing 20 cooperatively defines a receiving cavity 23. The display panel 10, the vibration glass layer 30, and the fastening frame 40 are received in the receiving cavity 23. In one embodiment, the display panel 10 is a touch panel.

The housing 20 includes a back cover 21 and a front frame 22. The protective glass 50 is fixed to the front frame 22. The display panel 10 is positioned on the back cover 21. The front frame 22 can be made of metal material and the back cover 21 can be made of plastic material, wood material or ceramic material.

The vibration glass layer 30 is positioned between the display panel 10 and the protective glass 50. The vibration glass layer 30 includes a transparent portion 31 and a sound generation portion 32. The transparent portion 31 is positioned on the display panel 10. The sound generation portion 32 extends from sides of the transparent portion 31 to the front frame 22.

The fastening frame 40 is positioned on the vibration glass layer 30 and positioned between the vibration glass layer 30 and the protective glass 50. In one embodiment, the fastening frame 40 is attached on the vibration glass layer 30 through adhesive. The fastening frame 40 is made of metal material or plastic material. The fastening frame 40 includes a base portion 41 and a plurality of rib portions 42. The base portion 41 is surrounding the transparent portion 31. The rib portions 42 extend from the base portion 41 to the front frame 22.

In the illustrated embodiment, the plurality of rib portions 42 includes four rib portions 42. The four rib portions 42 divide the sound generation portion 32 into five sound generation regions 320. The five sound generation regions 320 are independent from each other and have different areas. Each sound generation region 320 is corresponding to a respective frequency response range. The sound generation region 320 having a greater area is corresponding to a lower frequency response range. The sound generation region 320 having a smaller area is corresponding to a higher frequency response range. In details, the five sound generation regions 320 include one biggest sound generation region 3202, two middle sound generation regions 3204, and two smallest sound generation regions 3206. The biggest sound generation region 3202 is corresponding to a frequency response range of 200 Hz-2 kHz. The two middle sound generation regions 3204 are corresponding to a frequency response range of 2 kHz-20 kHz. The two smallest sound generation regions 3206 are corresponding to a frequency response range greater than 20 kHz.

The base portion 41 includes a filling layer 410. The filling layer 410 is filled with glass material and configured to fill a gap defined between the transparent portion 31 and the protective glass 50. In other embodiments, the filling layer 410 can be molded integrally with the protective glass 50.

Each sound generation region 320 is connected to an oscillator 322. The oscillator 33 is positioned on a central portion of each sound generation region 320.

The sound generation portion 32, the display panel 10, and the back cover 21 cooperatively define resonance cavities 300. When one sound generation region 320 is vibrating, sound pressure generates at two sides of the vibration glass layer 30 and the resonance cavities 300 amplify the sound pressure. In the illustrated embodiment, each sound generation region 320 defines a through hole 321. The through hole 321 is in communication with a respective one of the resonance cavities 300 and configured to balance the pressure of exterior and interior of the respective resonance cavity 300.

Figure 3:
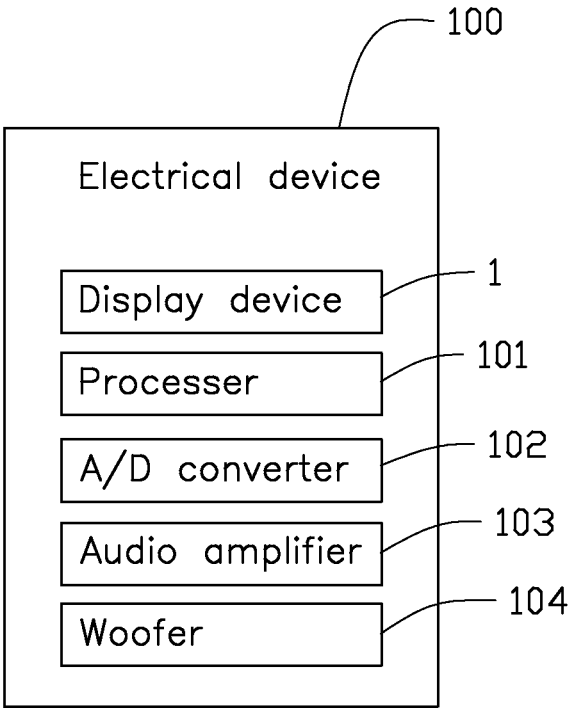
FIG. 3 is a block diagram illustrating the electrical device of FIG. 1.

Referring to FIG. 3, the electrical device 100 includes the display device 1, a processer 101, an A/D converter 102, an audio amplifier 103, and a woofer 104. The processer converts an audio signal from the electrical device 100 into a mechanical vibration signal. The A/D converter converts the mechanical vibration signal into an analogical signal. The audio amplifier 102 amplifies the analogical signal. The oscillator 322 receives the amplified analogical signal and vibrates the sound generation region 320, such that the sound generation region 320 generates sound wave.

The woofer 104 is positioned on the front frame 22 and is close to a side of the transparent portion 31 where there is no sound generation portion 32. The woofer 104 works in a frequency response range less than 200 Hz and is configured to produce a low frequency sound less than 200 Hz for the electrical device 100.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A display device, comprising:

a housing;

a protective glass, the protective glass and the housing cooperatively defining a receiving cavity;

a display panel received in the receiving cavity, the display panel positioned on the housing;

a vibration glass layer received in the receiving cavity, the vibration glass layer comprising a transparent portion and a sound generation portion, the transparent portion positioned on the display panel, the sound generation portion extending from sides of the transparent portion to the housing; and a fastening frame received in the receiving cavity, the fastening frame positioned on the vibration glass layer and positioned between the vibration glass layer and the protective glass, the fastening frame comprising a base portion and a plurality of rib portions, the base portion surrounding the transparent portion, the rib portion extending from the base portion to the housing, the rib portions dividing the sound generation portion into a plurality of sound generation regions, the sound generation regions having different areas.

2. The display device of claim 1, wherein the sound generation portion, the display panel, and the housing cooperatively define resonance cavities.

3. The display device of claim 2, wherein each sound generation region defines a through hole and the through hole is in communication with a respective one of the resonance cavities.

4. The display device of claim 1, wherein the plurality of rib portions comprises four rib portions, the four rib portions divide the sound generation portion into five sound generation regions, the five sound generation regions comprise one biggest sound generation region, two middle sound generation regions, and two smallest sound generation regions, the biggest sound generation region is corresponding to a frequency response range of 200 Hz-2 kHz, the two middle sound generation regions are corresponding to a frequency response range of 2 kHz-20 kHz, and the two smallest sound generation regions are corresponding to a frequency response range greater than 20 kHz.

5. The display device of claim 1, wherein the base portion comprises a filling layer between the transparent portion and the protective glass.

6. The display device of claim 5, wherein the filling layer is made of glass material.

7. The display device of claim 1, wherein the housing comprises a back cover and a front frame, the protective glass is positioned on the front frame and the display panel is positioned on the back cover.

8. The display device of claim 7, wherein the front frame is made of metal material.

9. The display device of claim 7, wherein the back cover is made of a material selected from one of the group consisting of plastic material, wood material and ceramic material.

10. An electrical device, comprising:

a display device comprising:

a housing;

a protective glass, the protective glass and the housing cooperatively defining a receiving cavity;

a display panel received in the receiving cavity, the display panel positioned on the housing;

a vibration glass layer received in the receiving cavity, the vibration glass layer comprising a transparent portion and a sound generation portion, the transparent portion positioned on the display panel, the sound generation portion extending from sides of the transparent portion to the housing; and a fastening frame received in the receiving cavity, the fastening frame positioned on the vibration glass layer and positioned between the vibration glass layer and the protective glass, the fastening frame comprising a base portion and a plurality of rib portions, the base portion surrounding the transparent portion, the rib portions extending from the base portion to the housing, the rib portions dividing the sound generation portion into a plurality of sound generation regions, the sound generation regions having different areas, each sound generation region connected to an oscillator;

a processer configured to convert an audio signal from the electrical device into a mechanical vibration signal;

an A/D converter configured to convert the mechanical vibration signal into an analogical signal; and an audio amplifier configured to amplify the analogical signal;

wherein when the oscillator receives the amplified analogical signal, the oscillator vibrates the sound generation region, such that the sound generation region generates sound wave.

11. The electrical device of claim 10, further comprising a woofer, wherein the woofer is positioned on the housing and is close to a side of the transparent portion.

12. The electrical device of claim 11, wherein the woofer works in a frequency response range less than 200 Hz and is configured to produce a low frequency sound less than 200 Hz for the electrical device.

13. The electrical device of claim 10, wherein the sound generation portion, the display panel, and the housing cooperatively define resonance cavities.

14. The electrical device of claim 13, wherein each sound generation region defines a through hole and the through hole is in communication with a respective one of the resonance cavities.

15. The electrical device of claim 10, wherein the plurality of rib portions comprises four rib portions, the four rib portions divide the sound generation portion into five sound generation regions, the five sound generation regions comprise one biggest sound generation region, two middle sound generation regions, and two smallest sound generation regions, the biggest sound generation region is corresponding to a frequency response range of 200 Hz-2 kHz, the two middle sound generation regions are corresponding to a frequency response range of 2 kHz-20 kHz, and the two smallest sound generation regions are corresponding to a frequency response range greater than 20 kHz.

16. The electrical device of claim 10, wherein the base portion comprises a filling layer between the transparent portion and the protective glass.

17. The electrical device of claim 16, wherein the filling layer is made of glass material.

18. The electrical device of claim 10, wherein the housing comprises a back cover and a front frame, the protective glass is positioned on the front frame and the display panel is positioned on the back cover.

19. The electrical device of claim 18, wherein the front frame is made of metal material.

20. The electrical device of claim 19, wherein the back cover is made of a material selected from one of the group consisting of plastic material, wood material and ceramic material.

* * * * *